US006523827B1

(12) United States Patent
Watson

(10) Patent No.: US 6,523,827 B1
(45) Date of Patent: Feb. 25, 2003

(54) BOARD GAME WITH PEGS AND DICE

(76) Inventor: Dale R. Watson, 24 Chapel St., Almond, NY (US) 14804

( * ) Notice: Subject to any disclaimer, the term of this patent is extended or adjusted under 35 U.S.C. 154(b) by 0 days.

(21) Appl. No.: 09/939,039

(22) Filed: Aug. 24, 2001

(51) Int. Cl.[7] ..... A63F 3/100
(52) U.S. Cl. ..... 273/248; 273/287; 273/290
(58) Field of Search ..... 273/236, 243, 273/287, 248, 290; D21/334, 338, 347, 345

(56) References Cited

U.S. PATENT DOCUMENTS

| | | | | | |
|---|---|---|---|---|---|
| 1,628,134 | A | | 5/1927 | Finlay | |
| 4,261,574 | A | * | 4/1981 | Rogers, Jr. | 273/146 |
| D269,284 | S | | 6/1983 | Woolwine | |
| 4,534,565 | A | * | 8/1985 | Hube | 273/241 |
| 4,813,678 | A | | 3/1989 | Collazo et al. | |
| 4,844,473 | A | | 7/1989 | Landsberg | |
| 4,927,155 | A | | 5/1990 | Bellinger | |
| 5,018,744 | A | * | 5/1991 | Patracuolia | 273/248 |
| 5,050,888 | A | | 9/1991 | Schultz et al. | |
| 5,085,441 | A | * | 2/1992 | Jova | 273/146 |
| 5,269,529 | A | * | 12/1993 | Clemente | 273/238 |
| 5,570,887 | A | * | 11/1996 | Christie, Jr. | 273/261 |
| 5,779,239 | A | * | 7/1998 | Lind | 273/243 |
| 6,062,562 | A | * | 5/2000 | Pardee | 273/243 |

* cited by examiner

*Primary Examiner*—Benjamin H. Layno
*Assistant Examiner*—Vishu K Mendiratta

(57) ABSTRACT

A board game with pegs and dice for providing a fun-filled game of strategy. The board game with pegs and dice includes a game board having a top side and also having a plurality of game-piece movement sections being arranged in rows upon the top side thereof; and also includes a plurality of game pieces for moving upon the game-piece movement sections; and further includes a pair of die for determining movement of the game pieces.

1 Claim, 1 Drawing Sheet

BOARD GAME WITH PEGS AND DICE

BACKGROUND OF THE INVENTION

1. Field of the Invention

The present invention relates to board games using pegs and dice and more particularly pertains to a new board game with pegs and dice for providing a fun-filled game of strategy.

2. Description of the Prior Art

The use of board games using pegs and dice is known in the prior art. More specifically, board games using pegs and dice heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,813,678; 4.927,155; 1,628,134; 4,844,473, 5,050,888; and U.S. Pat. No. Des. 269,284.

While these devices fulfill their respective, particular objectives and requirements, the aforementioned patents do not disclose a new board game with pegs and dice. The inventive device includes a game board having a top side and also having a plurality of game-piece movement sections being arranged in rows upon the top side thereof; and also includes a plurality of game pieces for moving upon the game-piece movement sections; and further includes a pair of die for determining movement of the game pieces.

In these respects, the board game with pegs and dice according to the present invention substantially departs from the conventional concepts and designs of the prior art, and in so doing provides an apparatus primarily developed for the purpose of providing a fun-filled game of strategy.

SUMMARY OF THE INVENTION

In view of the foregoing disadvantages inherent in the known types of board games using pegs and dice now present in the prior art, the present invention provides a new board game with pegs and dice construction wherein the same can be utilized for providing a fun-filled game of strategy.

The general purpose of the present invention, which will be described subsequently in greater detail, is to provide a new board game with pegs and dice which has many of the advantages of the board games using pegs and dice mentioned heretofore and many novel features that result in a new board game with pegs and dice which is not anticipated, rendered obvious, suggested, or even implied by any of the prior art board games using pegs and dice, either alone or in any combination thereof.

To attain this, the present invention generally comprises a game board having a top side and also having a plurality of game-piece movement sections being arranged in rows upon the top side thereof; and also includes a plurality of game pieces for moving upon the game-piece movement sections; and further includes a pair of die for determining movement of the game pieces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new board game with pegs and dice which has many of the advantages of the board games using pegs and dice mentioned heretofore and many novel features that result in a new board game with pegs and dice which is not anticipated, rendered obvious, suggested, or even implied by any of the prior art board games using pegs and dice, either alone or in any combination thereof.

It is another object of the present invention to provide a new board game with pegs and dice which may be easily and efficiently manufactured and marketed.

It is a further object of the present invention to provide a new board game with pegs and dice which is of a durable and reliable construction.

An even further object of the present invention is to provide a new board game with pegs and dice which is susceptible of a low cost of manufacture with regard to both materials and labor, and which accordingly is then susceptible of low prices of sale to the consuming public, thereby making such board game with pegs and dice economically available to the buying public.

Still yet another object of the present invention is to provide a new board game with pegs and dice which provides in the apparatuses and methods of the prior art some of the advantages thereof, while simultaneously overcoming some of the disadvantages normally associated therewith.

Still another object of the present invention is to provide a new board game with pegs and dice for providing a fun-filled game of strategy.

Yet another object of the present invention is to provide a new board game with pegs and dice which includes a game board having a top side and also having a plurality of game-piece movement sections being arranged in rows upon the top side thereof; and also includes a plurality of game pieces for moving upon the game-piece movement sections; and further includes a pair of die for determining movement of the game pieces.

Still vet another object of the present invention is to provide a new board game with pegs and dice that is easy and convenient to play.

Even still another object of the present invention is to provide a new board game with pegs and dice that can be played and enjoyed by people of all ages.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
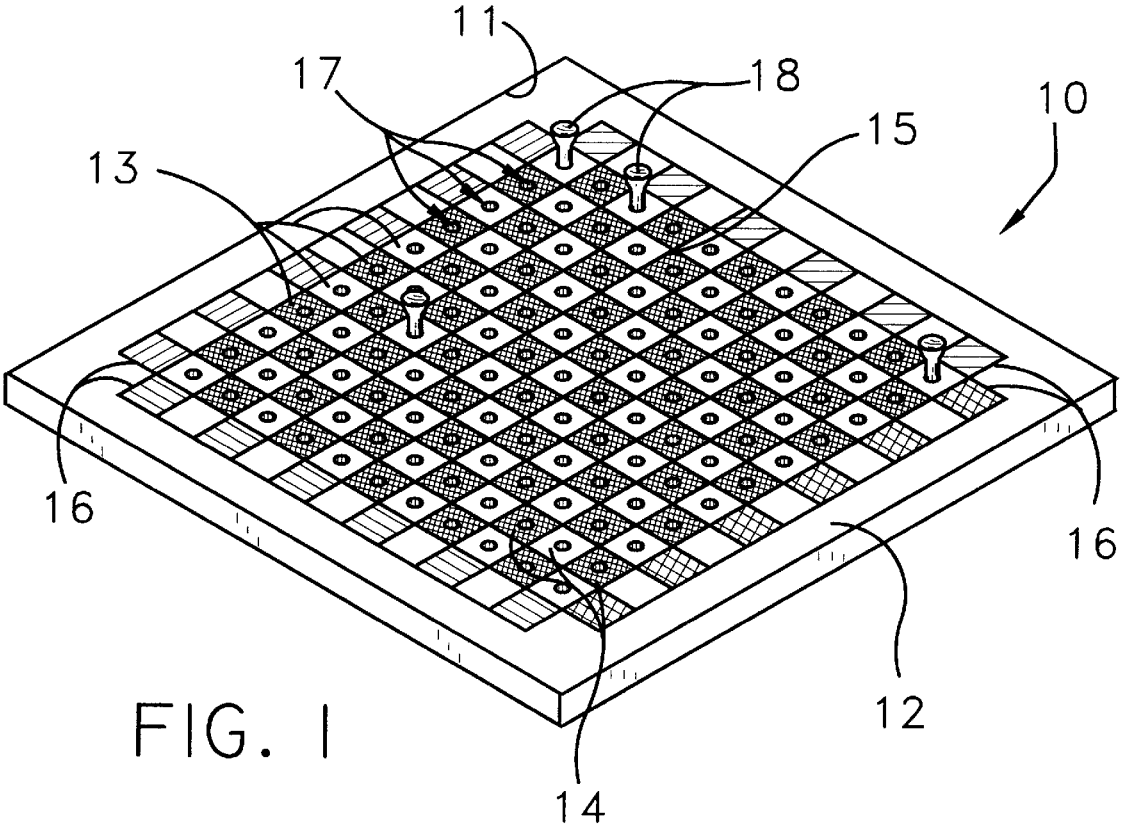
FIG. 1 is a perspective view of a new board game with pegs and dice according to the present invention.
Figure 2:
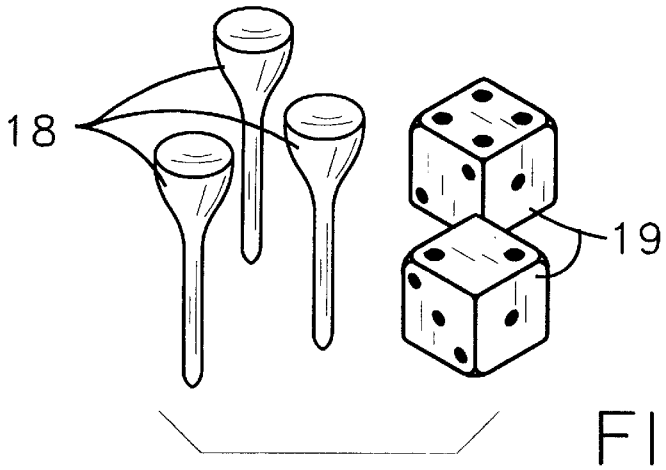
FIG. 2 is a perspective view of the peg members and dice of the present invention.

With reference now to the drawings, and in particular to FIGS. 1 through 2 thereof, a new board game with pegs and dice embodying the principles and concepts of the present invention and generally designated by the reference numeral 10 will be described.

As best illustrated in FIGS. 1 through 2, the board game with pegs and dice 10 generally comprises a game board 11 having a top side 12 and also having a plurality of game-piece movement sections 13 being displayed and arranged in rows 14 upon the top side 12 thereof. The game-piece movement sections 13 are arranged to form a squared-shaped grid 15 having sides. The rows 14 of the game-piece movement sections 13 include a plurality of home-base rows 16 which are disposed along the sides of the squared-shaped grid 15. The game-piece movement sections 13 of each home-base row 16 is distinctively colored. The game board 11 further includes a plurality of holes 17 being centrally disposed in the game-piece movement sections 13. A plurality of game pieces 18 for moving upon the game-piece movement sections 13 include peg members which are removably received in the holes 17 of the game-piece movement sections 13. The board game with pegs and dice 10 also comprises a pair of die 19 for determining movement of the game pieces 18.

In use, the game pieces 18 are placed in the holes 17 of game-piece movement sections 13 of a respective the home-base row 16. The pair of die 19 are tossed or rolled to determine movement of the game pieces 18. One or more game pieces 18 are moved upon the square-shaped grid 15 according to the numbers displayed face up upon the pair of die 19. The pair of die 19 are rolled and the game pieces 18 are moved until a player has moved all of one's game pieces 18 upon an opposed home-base row 16 which is disposed on an opposite side of the square-shaped grid 15 with respect to the player's home-base row 16. The board game is played such that the numbers displayed upon the pair of die 19 are totaled and one of the game pieces 18 is moved upon the square-shaped grid 15, or two of the game pieces 18 are moved with each of the game pieces 18 being moved according to the number displayed upon a respective die 19, or up to four of the game pieces 18 are moved upon the player rolling doubles upon the pair of die 19. Each game piece 18 can be moved only forward out of the player's home-base row 16, and can be moved only forward and sideways once upon the square-shaped grid 15. The game pieces 18 can be moved over and capture an opposing player's game piece 18, and can be moved around the opposing player's game pieces 18 when three of the opposing player's game pieces 18 are arranged in a row, and can be moved only around the player's own game piece 18. The game pieces 18 can be move upon the opposed home-base row 16 only upon the player rolling an exact number displayed upon the pair of die 19. The first player to place all of one's game pieces 18 in the opposed home-base row 16 wins the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a board game with pegs and dice comprises the steps of:

providing a game board having a plurality of game-piece movement sections being displayed thereupon and arranged in rows and forming a square-shaped grid and having holes centrally disposed therein with said game-piece movement sections having home-base rows being arranged along sides of said square-shaped grid, and also providing game pieces and a pair of die;

placing said game pieces in said holes of game-piece movement sections of a respective said home-base row:

rolling said pair of die to determine movement of said game pieces;

moving one or more of said game pieces upon said square-shaped grid a number of spaces corresponding to a number total displayed face up upon said pair of die;

repeating said rolling and moving steps until a player has moved all of the player's said game pieces upon an opposed said home-base row which is disposed on an opposite side of said square-shaped grid with respect to the player's said home-base row;

wherein the step of moving one or more of said game pieces includes the step of totaling the numbers displayed upon said pair of die and moving one of said game pieces upon said square-shaped grid or moving two of said game pieces with each of said game pieces being moved a number of spaces corresponding to the number displayed upon one of said die, wherein the step of moving one or more said game pieces includes the step of moving up to four of said game pieces upon the player rolling doubles upon said pair of die;

wherein the step of moving one or more said game pieces includes the step of moving only forward out of the player's home-base row, and moving only forward and sideways once upon said square-shaped grid;

wherein said step of moving one or more said game pieces includes the step of moving over and capturing an opposing player's said game piece, and moving around the opposing player's said game pieces when three of the opposing player's said game pieces are arranged in a row, and moving around the player's own said game piece; and wherein said step of moving one or more said game pieces includes the step of moving upon the opposed said home-base row upon rolling an exact number displayed upon said pair of die.

* * * * *